US009943977B2

(12) United States Patent
Secondi et al.

(10) Patent No.: US 9,943,977 B2
(45) Date of Patent: Apr. 17, 2018

(54) TENSIONING DEVICE FOR ROTARY CUTTING APPARATUS

(71) Applicant: SANDVIK INTELLECTUAL PROPERTY AB, Sandviken (SE)

(72) Inventors: Jacques Joseph Philippe Secondi, Monsteroux-Milieu (FR); Pierre-Luc Paul Andre Dijon, Salaise sur Sanne (FR)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/776,474

(22) PCT Filed: Mar. 14, 2013

(86) PCT No.: PCT/IB2013/000942
§ 371 (c)(1),
(2) Date: Sep. 14, 2015

(87) PCT Pub. No.: WO2014/140669
PCT Pub. Date: Sep. 18, 2014

(65) Prior Publication Data
US 2016/0023367 A1 Jan. 28, 2016

(51) Int. Cl.
*B26D 7/14* (2006.01)
*B26F 1/38* (2006.01)
*B26D 1/40* (2006.01)

(52) U.S. Cl.
CPC ..... *B26D 7/14* (2013.01); *B26D 1/405* (2013.01); *B26F 1/384* (2013.01); *B26D 1/40* (2013.01)

(58) Field of Classification Search
CPC .... B26D 7/14; B26D 7/18; B26D 2007/1809; B26D 7/1818; B26D 7/1854; B26D 7/1863; B26D 7/2614
USPC ..... 83/117, 653, 99, 113, 123, 128
See application file for complete search history.

(56) References Cited

U.S. PATENT DOCUMENTS 646,346 A * 3/1900 Batten ..... B26D 7/1818 83/116
3,827,322 A * 8/1974 Saunders ..... B26D 7/1818 83/128
3,875,836 A 4/1975 Hutchinson et al.
4,224,851 A * 9/1980 Imai ..... B26D 7/1818 83/113
4,305,716 A * 12/1981 Nickum ..... B23P 15/406 493/342
4,397,203 A 8/1983 Brack
4,404,879 A * 9/1983 Frohwerk ..... B26D 1/62 53/133.8

(Continued)

FOREIGN PATENT DOCUMENTS

CN 201406215 Y 2/2010
CN 202412345 U 9/2012

(Continued)

*Primary Examiner* — Jennifer Swinney
*Assistant Examiner* — Richard Crosby, Jr.
(74) *Attorney, Agent, or Firm* — Eric Shaffer

(57) ABSTRACT

A rotary cutting apparatus including a frame, a die roll rotatably attached to the frame including a cutting member, wherein the cutting member includes at least one tensioning device and the tensioning device includes a body and a tip portion adjacent to the body, the tensioning device having an unsymmetrical profile.

10 Claims, 6 Drawing Sheets

(56) References Cited

U.S. PATENT DOCUMENTS 4,480,516 A * 11/1984 Leroy ..... A61F 13/15723 83/110
4,534,251 A * 8/1985 Wilson ..... B26D 7/1818 83/111
4,640,165 A * 2/1987 McMahon ..... B26D 7/2614 83/346
4,642,150 A * 2/1987 Stemmler ..... A61F 13/15593 156/164
5,881,620 A * 3/1999 Smithwick, Jr. ..... B26D 7/1818 493/342
6,076,444 A * 6/2000 Okonski ..... B26D 7/018 83/100
6,644,153 B1 * 11/2003 Gordon ..... B26D 7/1818 493/342
6,681,666 B2 * 1/2004 Pfaff, Jr. ..... B26D 7/1836 76/107.1
6,715,394 B2 * 4/2004 O'Dell ..... B26D 7/1863 83/100
6,925,918 B1 * 8/2005 Bunge ..... B26D 7/1818 83/116
6,966,245 B1 * 11/2005 Simpson ..... B26D 7/1818 83/27
7,455,006 B2 * 11/2008 Toth ..... B26D 7/2614 76/107.1
7,798,039 B2 * 9/2010 Schurch ..... B26D 1/385 83/13
8,166,858 B2 * 5/2012 Luquette ..... B26D 7/1818 83/115
8,459,159 B2 * 6/2013 Jessen ..... B26D 7/18 83/123
8,549,967 B1 * 10/2013 Smithwick, Jr. ..... B26D 7/01 83/117
8,656,817 B2 * 2/2014 Fritz ..... B26D 5/02 83/305
2003/0159558 A1 * 8/2003 Takayama ..... B26D 7/1854 83/100
2004/0121121 A1 6/2004 Anderson et al.
2007/0161487 A1 * 7/2007 Ryczek ..... B26D 1/385 493/427
2007/0251364 A1 * 11/2007 Blumle ..... B26D 7/018 83/100
2009/0114071 A1 * 5/2009 Mardian ..... A61F 13/15723 83/113
2012/0285306 A1 * 11/2012 Weibelt ..... B26D 7/1818 83/86

FOREIGN PATENT DOCUMENTS

| | | | |
|---|---|---|---|
| DE | 102009000240 | A1 | 7/2010 |
| EP | 105748 | A1 | 4/1984 |
| GB | 2335880 | A | 10/1999 |
| JP | H07-36333 | U | 7/1995 |
| JP | 2001139198 | A | 5/2001 |
| JP | 200340503 | A | 2/2003 |
| JP | 2005-001012 | A | 1/2005 |
| SU | 425778 | A1 | 4/1974 |
| SU | 1691096 | A | 11/1991 |
| WO | 2008043171 | A1 | 4/2008 |

* cited by examiner (D)
(E)
(F)
21
19
75
76
21
71
77
78
21
73
80
79

TENSIONING DEVICE FOR ROTARY CUTTING APPARATUS

RELATED APPLICATION DATA

This application is a § 371 National Stage Application of PCT International Application No. PCT/IB2013/000942 filed Mar. 14, 2013.

TECHNICAL FIELD AND INDUSTRIAL APPLICABILITY

The present disclosure relates to a tensioning device for creating tension on a material during the cutting of a material by a rotary cutting apparatus including a die roll. The tensioning device may be affixed to a die roll or affixed to an insert on the die roll.

SUMMARY

Presently, non-woven materials have become more advanced. It is quite common to have different types materials such as films and fibers that are bound together either by co-laminating, gluing and welding and bonding. The intent is to integrate more functionalities into these materials. For example, two materials are bonded together and one of the materials is soft to the touch on one side and while the other material is robust and acts as a support for the soft material. The materials may exhibit different characteristics depending on the orientation of the materials, for instance they can deform in one preferred direction.

These advanced materials are also more difficult to cut. When cutting, it is common to create tension on the material, in order to make the cut easier. This tension is created in the machine direction on the converting lines. The advanced materials, having preferred direction for elongation, are typically cut in the cross direction of the converting line.

To create tension on the material, "web spreaders" may be used. They are placed before the material is cut but are not effective enough during the cut due to the properties of the advanced materials.

As a consequence, cutting these advanced materials is more difficult and requires thinner edges and higher forces. Further, using existing technologies to create tension on an advanced material creates wrinkles on the materials which result in poor quality of the final cut product.

The embodiments presented herein have many advantages and solve the problems of cutting the aforementioned advanced materials. For example, tensioning can be created in a cross direction during the cut, while prior systems are active only before cutting or after cutting. Embodiments presented herein avoid creating wrinkles in the material. Embodiments presented herein can be adjusted by varying the geometry of the tensioning device. Embodiments presented herein require no adjustment of the rotary cutting device, which makes the system easy to use. Embodiments presented herein may be combined with vacuum in order to permit transfer of trim or product away from the rotary cutting apparatus.

In one embodiment, a tensioning device for a rotary cutting apparatus includes a body, a tip portion adjacent to the body and a base supporting the body, wherein the tensioning device has an unsymmetrical profile.

In another embodiment, a tensioning device for a rotary cutting apparatus includes a body and a tip portion having an unsymmetrical profile.

In yet another embodiment, a rotary cutting apparatus includes a frame and a die roll rotatably attached to the frame including a cutting member, wherein the die roll includes at least one tensioning device having an unsymmetrical profile further including a body and a tip portion adjacent to the body. The tensioning device may be affixed to the die roll or affixed to an insert on the die roll.

In another embodiment, a method for cutting a material includes providing a rotary cutting apparatus having a frame and a die roll rotatably attached to the frame; the die roll includes a cutting member and at least one tensioning device. The tensioning device may be affixed to the die roll or affixed to an insert on the die roll. The tensioning device has a body and a tip portion adjacent to the body wherein the profile of the tensioning device is unsymmetrical. An anvil roll is provided adjacent the cutting member. Material is provided between the die roll and the anvil roll and the material is advanced in the machine direction. The material is pinched between the cutting member, the tensioning device and the anvil roll and, simultaneously, the material is cut.

These and other objects, features, aspects, and advantages will become more apparent from the following detailed description of the preferred embodiments relative to the accompanied drawings.

DETAILED DESCRIPTION

Various non-limiting embodiments of the present disclosure will now be described to provide an overall understanding of the principles of the structure, function, manufacture, and use of the apparatuses and methods disclosed herein. One or more examples of these non-limiting embodiments are illustrated in the accompanying drawings. Those of ordinary skill in the art will understand that the apparatuses and methods specifically described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

In general, a rotary cutting apparatus may comprise a frame, a die roll assembly rotatably attached to the frame, and an anvil roll assembly rotatably attached to the frame. The die roll assembly may comprise a die roll and the anvil roll assembly may comprise an anvil roll. The die roll assembly may also comprise at least one cutting member configured to be forced against the anvil roll, as the anvil roll rotates relative to the die roll, to cut a material being fed through the nip of the die roll and the anvil roll.

Figure 1:
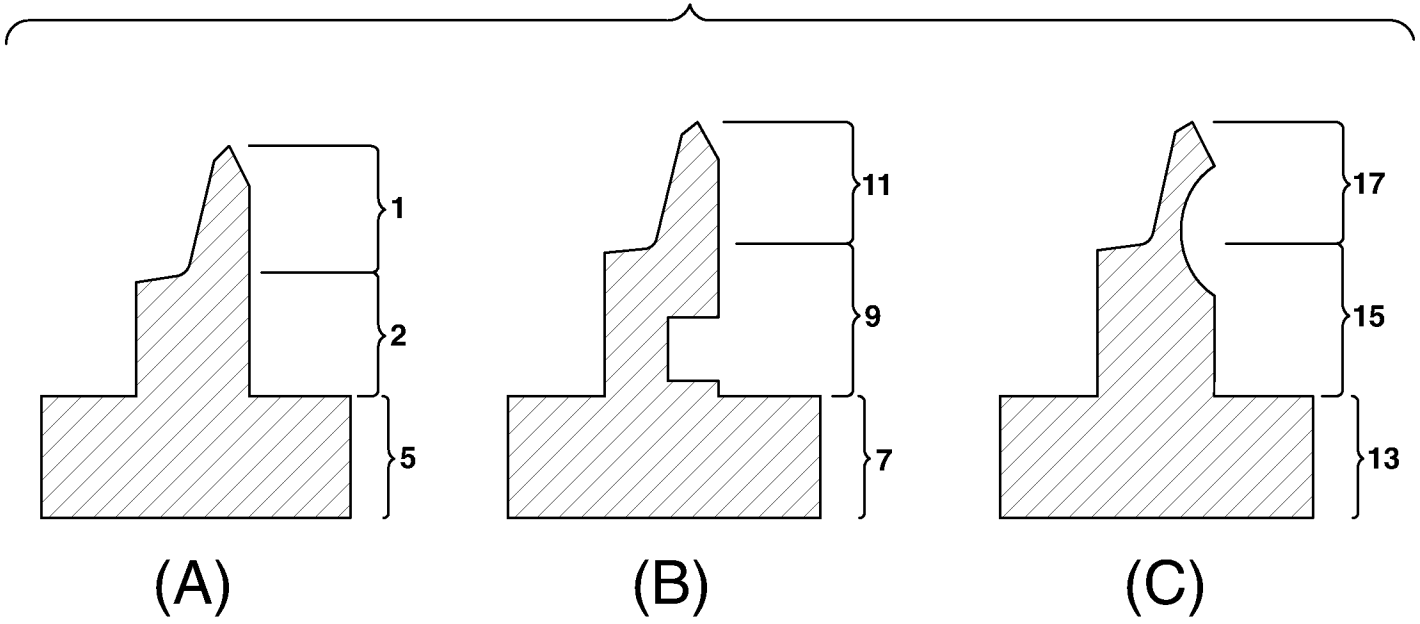
FIG. 1 depicts side views of embodiments of a tensioning device according to three non-limiting embodiments.
Figure 1A:
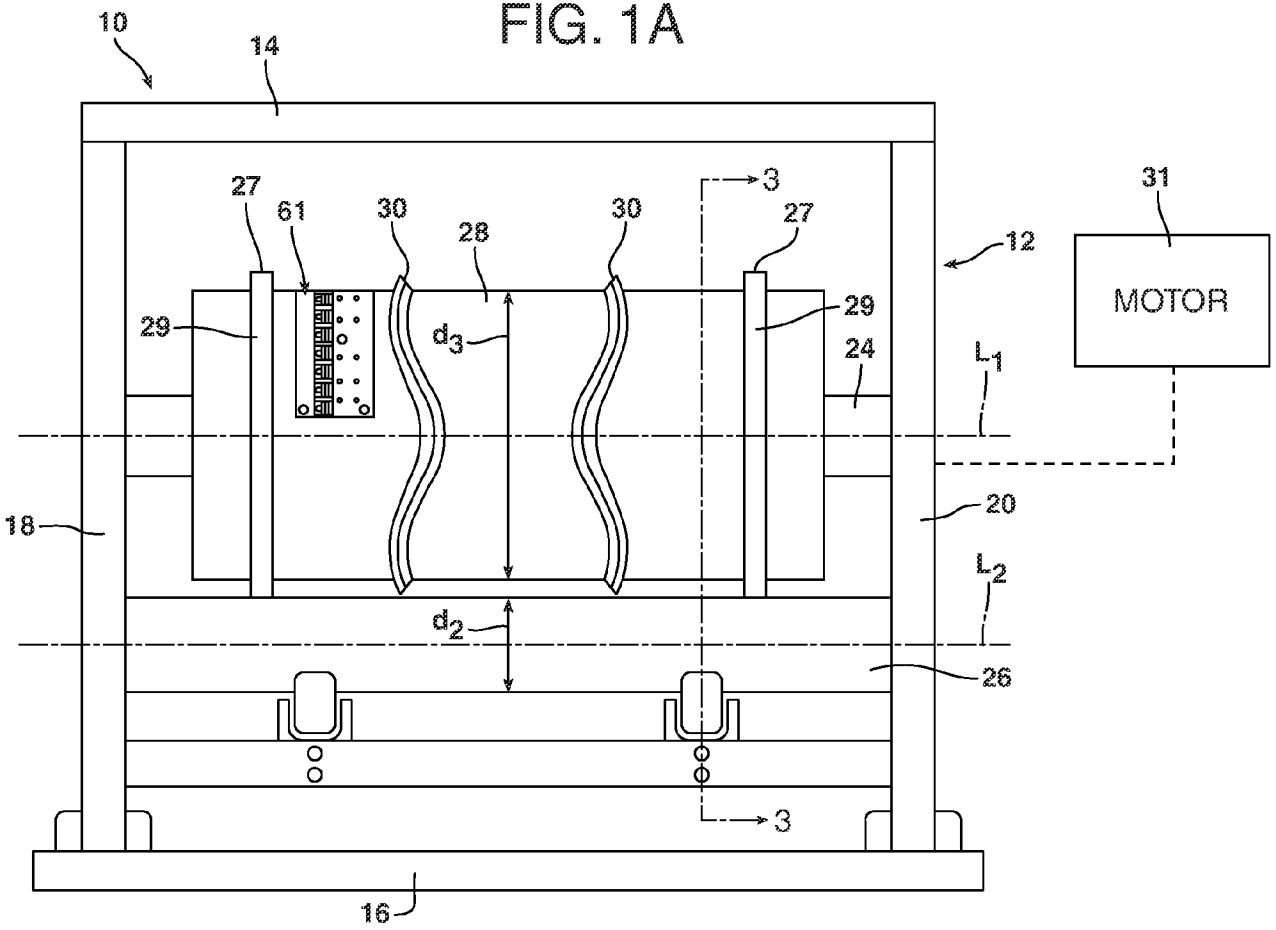
FIG. 1*a* is a perspective view of a rotary cutting apparatus according to one non-limiting embodiment.

In one embodiment, referring to FIG. 1*a*, a rotary cutting apparatus 10 may comprise a frame 12 comprising a top plate 14, a bottom plate 16, a first side plate 18, and/or a second side plate 20, for example. As is to be appreciated, various components have been removed, or otherwise simplified, for clarity. The first side plate 18 and the second side plate 20 may be connected to the top plate 14 and the bottom plate 16 through any methods known in the art, such as bolting, screwing, and/or welding, for example. The bottom plate 16 of the frame 12 may be mounted to a surface or a rigid member to maintain the frame 12 of the rotary cutting apparatus 10 in a fixed position for operation. The mounting of the frame 12 may be accomplished through any methods known in the art, such as bolting, screwing, and/or welding, for example.

In one embodiment, still referring to FIG. 1*a*, the longitudinal axis L1 of the die roll 28 may be parallel to, or substantially parallel to, the longitudinal axis L2 of the anvil roll 26. In one embodiment, the anvil roll 26 may be formed from a single rigid piece of material or may be formed with a center portion and a surface material at least partially surrounding the center portion. In one embodiment, the anvil roll 26 may comprise tungsten carbide, tool steel, and/or any other suitable materials for forming an anvil roll 26. In various embodiments, the outer radial surface may comprise a material positioned on the anvil roll 26 or integrally formed with the anvil roll 26, such as tungsten carbide, tool steel, and/or any other suitable material for forming the outer radial surface of the anvil roll 26. The anvil roll 26 is position next to and along a perpendicular axis with a plurality of wheels 40, each of said wheels 40 contained at least in part by an individual bracket 41. The plurality of individual brackets 41 are each mounted onto a portion 42 of a mounting bar 38, said mounting bar 38 is parallel to and above the a bottom plate 16. The bottom plate 16 is attached substantially perpendicular to the first side 18 and the second side 20 by at least one mounting bracket 46.

In one embodiment, referring to FIG. 1*a*, the die roll 28 may be driven by a motor assembly, schematically shown by motor assembly 31. The motor assembly 31 may comprise a power source and any suitable motor or other device for imparting a rotation upon a shaft 24. The motor assembly 31 may be configured to be engaged with the shaft 24 of the die roll assembly 28 through any suitable means, such as a drive shaft (not shown). The motor assembly 31 may rotate the outer surface 27 of optional bearer rings 29, owing to the engagement of the bearer rings 29 with the die roll 28, at a first speed. The outer surface 27 of each of the bearer rings 29 may be configured to engage the outer radial surface of the anvil roll 26 to drive the anvil roll 26 owing to frictional engagement between the outer surface 27 of the bearer rings 29 and the outer radial surface of the anvil roll 26. In one embodiment, the outer radial surface of the anvil roll 26 can then rotate at a second speed. The speed of the outer surface 27 of the bearer rings 29 may be the same as or substantially the same as the speed of the outer radial surface of the anvil roll 26. In other embodiments, the drive shaft of the motor assembly 31 may be used to drive the anvil roll 26 by conventional methods.

Figure 6:
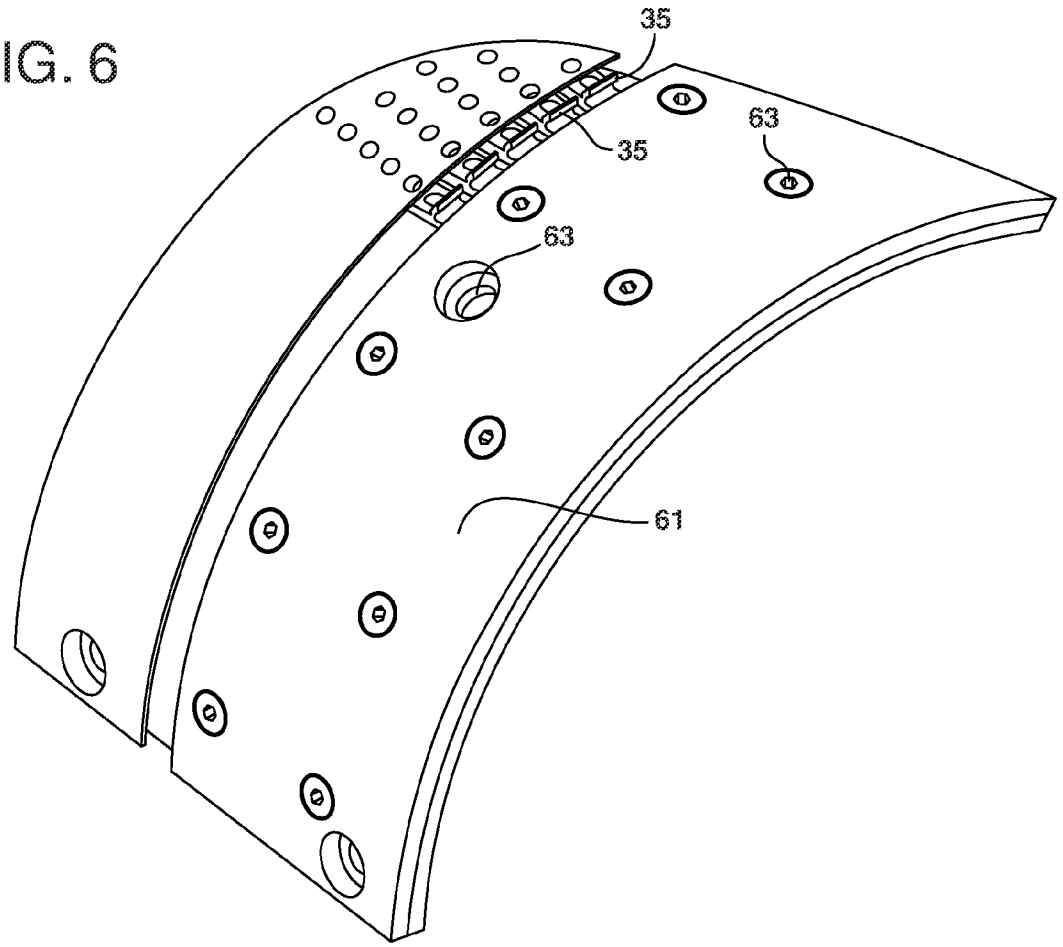
FIG. 6 is a perspective view of one embodiment of a tensioning device and an insert

In one embodiment, die roll 28 may include an insert 61 having at least one tensioning device 35 (see FIG. 6) affixed on the insert 61. The insert 61 may be attached to the die roll 28 by means of screws, glue or other means of attachment. The insert 61 may be constructed of steel, aluminum, metal, ceramics, composites, plastics and other equivalent materials and combinations of the aforementioned materials. As shown in FIG. 6, insert 61 may contain holes 63 where screws may be inserted to attach the insert 61 to the die roll 28. Optionally, the at least one tensioning device 35 may be attached to the die roll without the use of an insert. The at least one tensioning device 35 may be attached to the die roll 28 by means of adhesives, glues, screws or welding. The placement of the at least one tensioning device 35, or insert including the at least one tensioning device, may be anywhere on the die roll 28 so long as it is between the end of the die roll 28 and the cutting member 30

Optionally, there may be more than one insert 61, including at least one tensioning device 35, on the die roll 61. The number of inserts 61 depends on one or more of the following: profile of the cutting member, number of prints per turn of the die roll 28 and/or on the need to vacuum and blow or trim the material.

In an embodiment, as shown in FIG. 1, tensioning devices A,B,C for a rotary cutting apparatus include a body 2,9,15, a tip portion 1,11,17 adjacent to the body 2,9,15 and a base 5,7,13 supporting the body 2,9,15, wherein the tensioning devices A,B,C have unsymmetrical profiles. The geometry of the tensioning device may be altered depending on the desired tension effect when cutting a material. For example, it is possible to increase the height of the tip portion 1,11,17 and/or the body 2,9,15 to cause the tensioning device to deform more and create more tension on the material to be cut.

In an embodiment, referring to FIG. 1, the thickness of the tip portion 1,11,17 may be less than that of the body 3,9,15. Alternatively, thickness of the base 7 is greater than that of the body 9 and the tip portion 11. In an embodiment, the thickness of the tip portion 1,11,17 is about 0.1 cm to about 1.0 cm, the thickness of the body 3,9,15 is from about 0.2 cm to about 2.0 cm, and thickness of the base 5,7,13 is from about 0.8 cm to about 3.0 cm.

Figure 2:
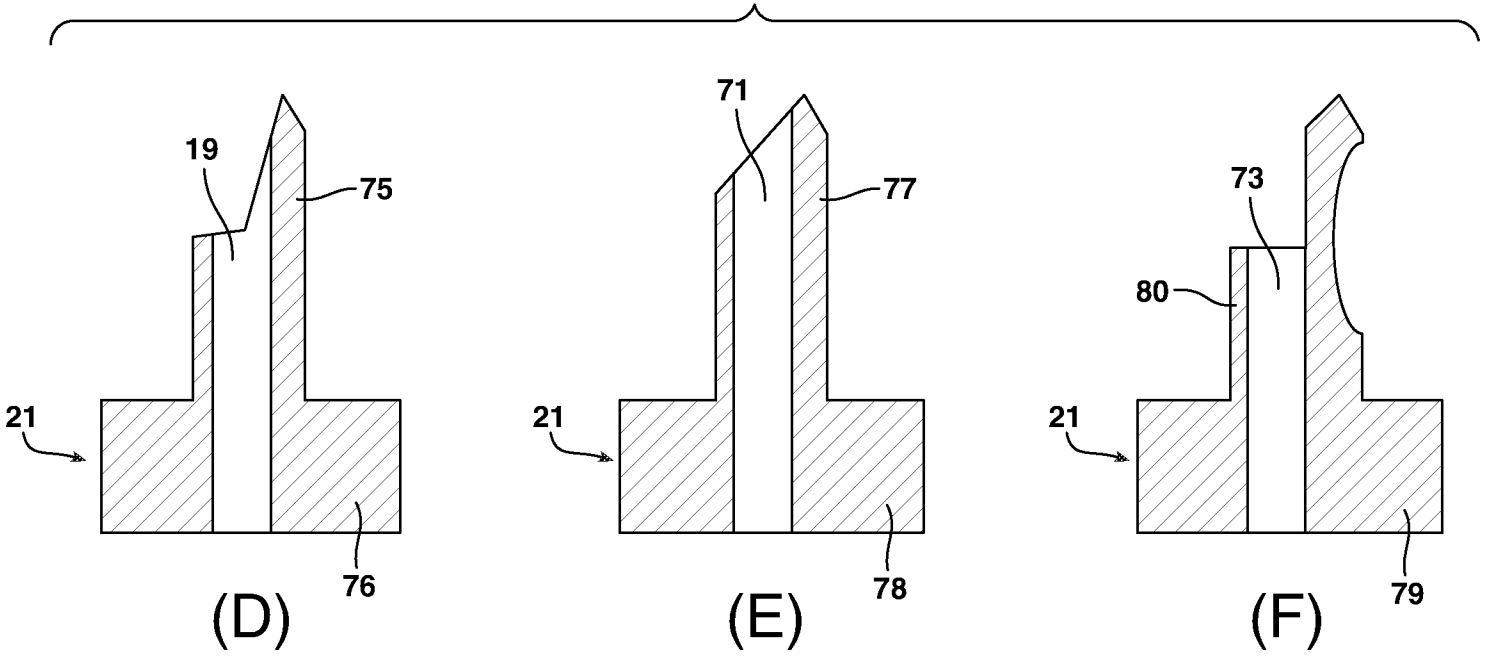
FIG. 2 depicts side, cut-away views of embodiments of a tensioning device according to three non-limiting embodiments.

In an embodiment, as shown in FIG. 2, the tensioning device D,E includes at least one vacuum orifice 19,71 extending from the tip 75,77 through the base 76,78 of the tensioning device. Alternatively, the tensioning device F may include at least one vacuum orifice extending from the base 79 through the body of the tensioning device.

The vacuum orifice 19,71,73 reinforces the holding of the material during cutting and complements the tensioning device. The tensioning device 21 is useful during cutting as it decreases the needed cutting force and the vacuum may be used for transferring trim or product from the cutting location to the trim pipe or product conveyor.

Figure 3:
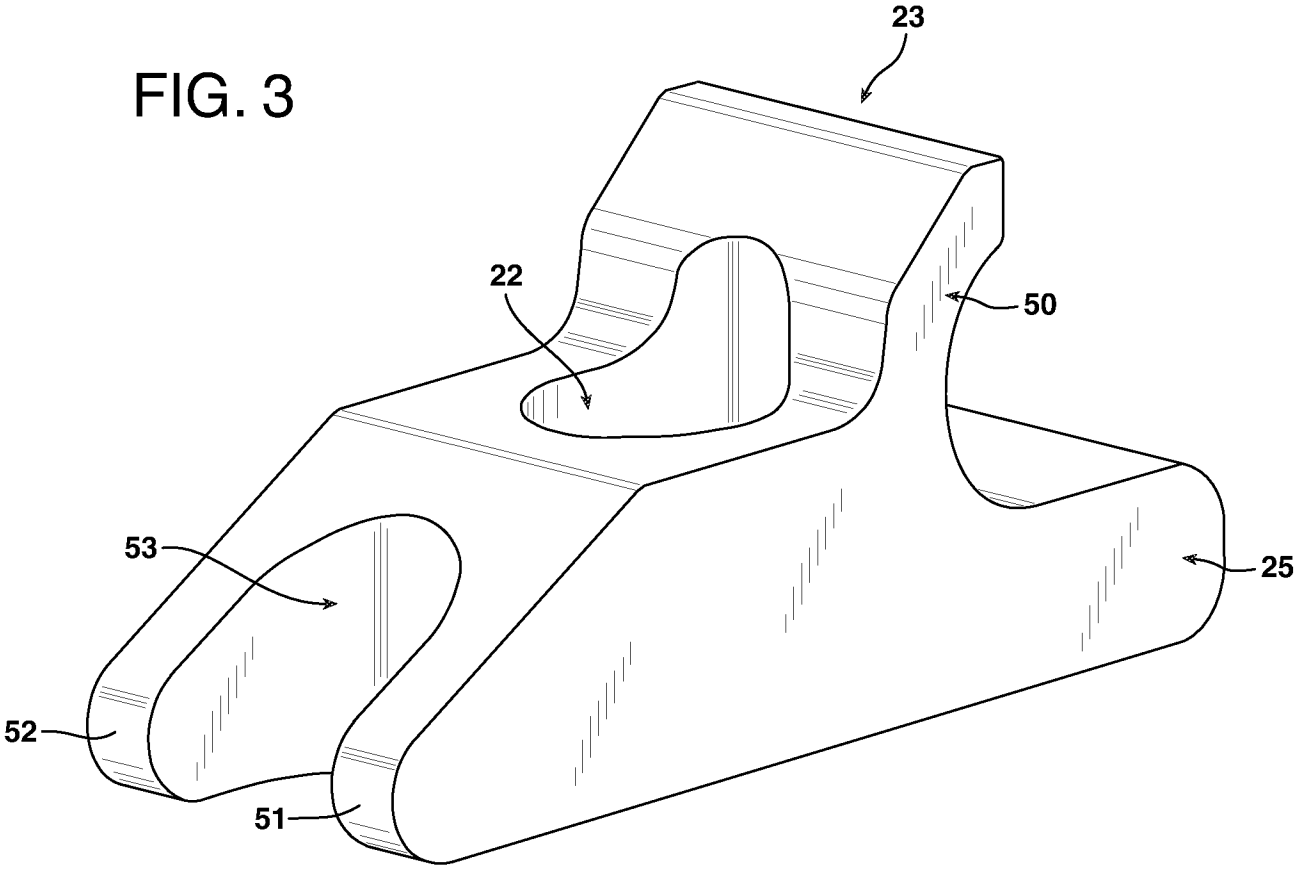
FIG. 3 is a perspective view of one embodiment of a tensioning device according to one non-limiting embodiment.

In an embodiment, as shown in FIG. 3, a tensioning device 23 includes a body 25 and a tip portion 50. The tensioning device 23 has an unsymmetrical profile. The tensioning device 23 may include at least one vacuum orifice 22 extending from a least part of the tip portion 27 through the body 25. The tensioning device many include at least one foot 53 extending from the body 25.

Figure 4:
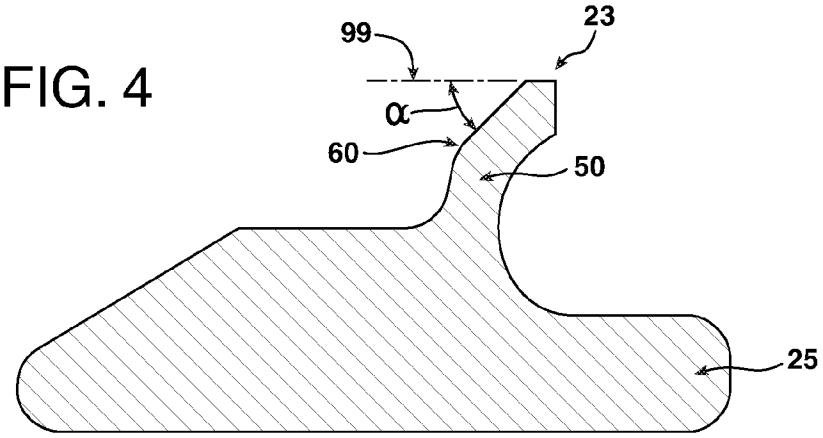
FIG. 4 is a side view of one embodiment of a tensioning device according to one non-limiting embodiment.

In an embodiment, as shown in FIG. 4, an angle, defined between the top surface 59 and the side surface 60 of the tip portion 50, is between about 0 and about 45 degrees. As shown in FIGS. 3 and 4, the thickness of the tip portion 50 may be less than that of the body 25. Further, the thickness of the tip portion 50 is about 0.1 cm to about 1.0 cm and the thickness of the body 25 is from about 0.2 cm to about 2.0 cm. As shown in FIG. 3, in an embodiment, the tensioning device 23 may include at least one vacuum orifice 22 extending from the tip 50 through the base 25 of the device. As shown in FIG. 3, the tensioning device 23 includes a first foot 51 and a second foot 52 adjacent the first foot 51. Further, in an embodiment, the vacuum orifice 22 extends through the base 25 and between first foot 51 and second foot 52.

Figure 5:
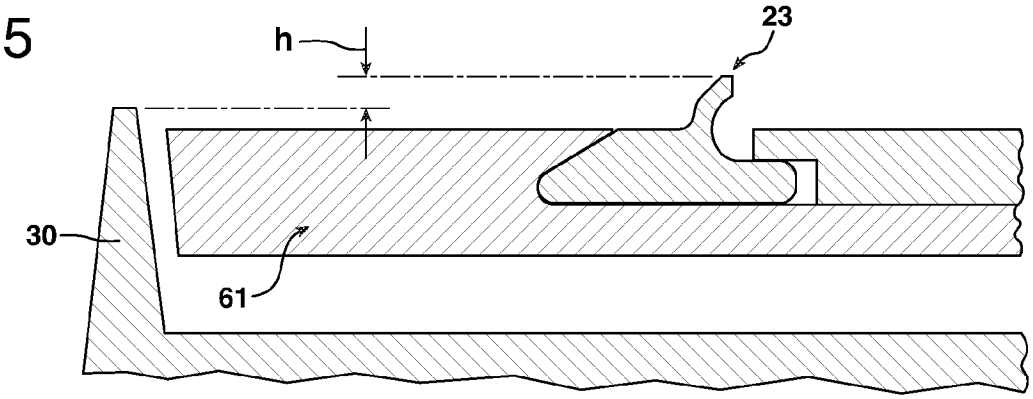
FIG. 5 is a side view of one embodiment of a tensioning device according to one non-limiting embodiment.

As indicated, the tensioning device may be directly attached to the die roll 28 or may be attached to an insert 61 that is attached to the die roll 28 as shown in FIGS. 5 and 6. The insert 61 may extend entirely or partially around the die roll 28 and may be attached to the die roll by means of screws, adhesives, as indicated above.

In an embodiment, and as shown in FIGS. 1*a* and 6, a method for cutting a material includes providing a rotary cutting apparatus 10 including a frame 12 and a die roll 28 rotatably attached to the frame 12, the die roll 28 including cutting member 30. The die roll 28 includes at least one tensioning device 35 having a body 25 and a tip portion 50 adjacent to the body 25. The tensioning device 23 has an unsymmetrical profile. As indicated, the tensioning device may be directly attached to the die roll 28 or may be attached to an insert 61 that is attached to the die roll 28 as shown in FIGS. 5 and 6. Adjacent the cutting member 30 is anvil roll 26. Material W is fed, in the machine direction, between the die roll 28, including cutting member 30, and the anvil roll 26. The material is pinched by the tensioning device 23 and held in place momentarily, between the anvil roll 26 and the die roll 28 including the cutting member 30, by the tensioning device 23 and, simultaneously, the material is cut. In an embodiment, during the pinching/cutting step, the tensioning device deforms laterally about 1 mm, creating a tension in the cross direction D of about 2%. In an embodiment, during the pinching/cutting step the tensioning device deforms laterally greater than 0 to about 5 mm, creating a tension in the cross direction D from greater than 0 to about 10%

In an embodiment, there may be one or a series of tensioning devices placed on one end of the die roll and a second tensioning device or a series of second tensioning device placed on the opposite end of the die roll.

In one embodiment, the material cut (not shown) by the rotary cutting apparatus 10 may be a web configured for use in fabricating absorbent articles, such as diapers, training diapers, pull-up pants, incontinence briefs, feminine hygiene articles, and undergarments, for example. In various other embodiments, the material being cut may comprise any material that may be processed by a rotary cutting apparatus, such as corrugated plastic, corrugated fiberboard, card stock, thin metal sheets and/or any other suitable material. In an embodiment, the material may have a width up to about 1200 mm. In an embodiment the material may have a width of from about 30 mm to about 1200 mm.

In an embodiment, deformation of the material is controlled by a parameter such as the geometry of the tip portion, geometry of the body, the angle of the tip portion, length of the tensioning device or hardness of the tensioning device. Combinations of all or at least two of these parameters may be used.

There are many advantages to the tensioning device including that it can create a tension in cross direction during the cut, while other systems, currently known, are active only before cutting or after cutting. The tensioning device prevents wrinkles in the material due to tension in machine direction. There is no adjustment required which makes the system robust and easy to use. The tensioning device may be combined with vacuum in order to allow proper transfer of trim or product.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

The invention claimed is:

1. A rotary cutting apparatus arranged to cut a material fed in a machine direction along a cross-direction, the cross-direction comprising a material feed path oriented at an oblique angle relative to the axis of the rotary cutting apparatus, the cutting apparatus comprising:

a frame; and a die roll rotatably attached to the frame including a cutting member, the die roll including at least one tensioning device affixed to the die roll, wherein the at least one tensioning device comprises a body and a tip portion adjacent to the body, wherein the at least one tensioning device, attached to the die roll, has an unsymmetrical profile positioned to create tension on the material;

wherein the device comprises at least one vacuum orifice extending from the tip through the base of the device.

2. The apparatus of claim 1, further comprising an anvil roll rotatably attached to the frame.

3. The apparatus according to claim 1, further comprising at least one insert.

4. The apparatus according to claim 3, wherein the at least one tensioning device is attached to the insert.

5. The apparatus of according to claim 1, wherein the tensioning device is a polymer selected from the group of latex, gum and polyurethane.

6. The apparatus according to claim 1, wherein the thickness of the tip portion is less than that of the body.

7. The apparatus according claim 1, wherein the thickness of the tip portion is about 0.1 cm to about 3.0 cm.

8. The apparatus according to claim 1, wherein the thickness of the base is greater than that of the body and the tip portion.

9. A rotary cutting apparatus arranged to cut a material fed in a machine direction along a cross-direction, the cross-direction comprising a material feed path oriented at an oblique angle relative to the axis of the rotary cutting apparatus, the cutting apparatus comprising:

a frame; and a die roll rotatably attached to the frame including a cutting member, the die roll including at least one tensioning device affixed to the die roll, wherein the at least one tensioning device comprises a body and a tip portion adjacent to the body, wherein the at least one tensioning device, attached to the die roll, has an unsymmetrical profile positioned to create tension on the material; and wherein the device comprises at least one vacuum orifice extending from the tip through the base of the device.

10. A rotary cutting for cutting a feed of material comprising:

a frame; and a die roll rotatably attached to the frame including a cutting member;

at least one tensioning device affixed to the die roll, wherein the at least one tensioning device comprises a body and a tip portion adjacent to the body, wherein the at least one tensioning device, has an unsymmetrical profile and is configured to deform laterally during cutting to create tension in a material in a direction at an oblique angle relative to a direction by which the material is fed to the apparatus; and wherein the device comprises at least one vacuum orifice extending from the tip through the base of the device.

* * * * *